US007168217B2

(12) United States Patent
Weber

(10) Patent No.: US 7,168,217 B2
(45) Date of Patent: Jan. 30, 2007

(54) INTERCONNECTABLE PANEL SYSTEM AND METHOD OF PANEL INTERCONNECTION

(75) Inventor: Jürgen Weber, Ense (DE)

(73) Assignee: Fritz Egger GmbH & Co., Unterradlberg (AT)

( * ) Notice: Subject to any disclaimer, the term of this patent is extended or adjusted under 35 U.S.C. 154(b) by 363 days.

(21) Appl. No.: 10/794,775

(22) Filed: Mar. 5, 2004

(65) Prior Publication Data

US 2004/0200175 A1 Oct. 14, 2004

(30) Foreign Application Priority Data

Mar. 24, 2003 (DE) ..... 103 13 112

(51) Int. Cl.
*E04B 2/00* (2006.01)

(52) U.S. Cl. ..... 52/592.1

(58) Field of Classification Search ..... 52/592.1, 52/592.2, 592.6, 578, 589.1
See application file for complete search history.

(56) References Cited

U.S. PATENT DOCUMENTS

| | | | | |
|---|---|---|---|---|
| 4,426,820 | A | 1/1984 | Terbrack et al. | |
| 6,006,486 | A * | 12/1999 | Moriau et al. | 52/589.1 |
| 6,216,409 | B1 * | 4/2001 | Roy et al. | 52/589.1 |
| 6,871,292 | B1 * | 3/2005 | Fischer et al. | 713/500 |
| 6,931,811 | B1 * | 8/2005 | Thiers | 52/592.1 |
| 2002/0020127 | A1 | 2/2002 | Thiers et al. | |

* cited by examiner

*Primary Examiner*—Hugh B. Thompson, II
(74) *Attorney, Agent, or Firm*—Fish & Neave IP Group of Ropes & Gray LLP; Jeffrey H. Ingerman

(57) ABSTRACT

Interconnectable panels having tongue-and-groove connections are mechanically connected to each other by first moving two panels into an intermediate position and then pivoting one panel with respect to the other. The underside of the tongue of one panel has a depression, while the groove of another panel has a protruding lower lip. The lower lip has a projection that fits in the depression when the two panels are in the intermediate position.

10 Claims, 12 Drawing Sheets

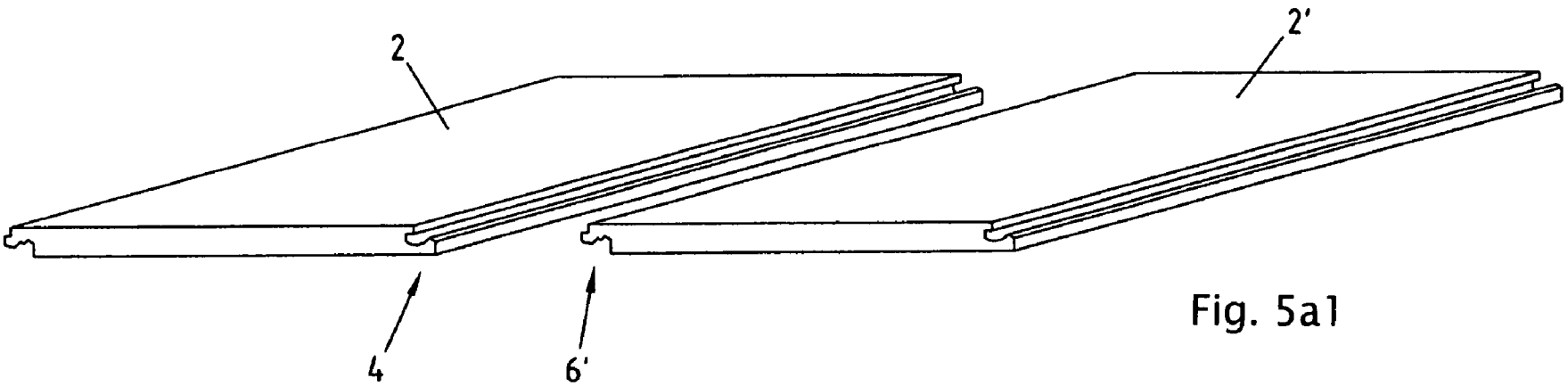
Fig. 5a1
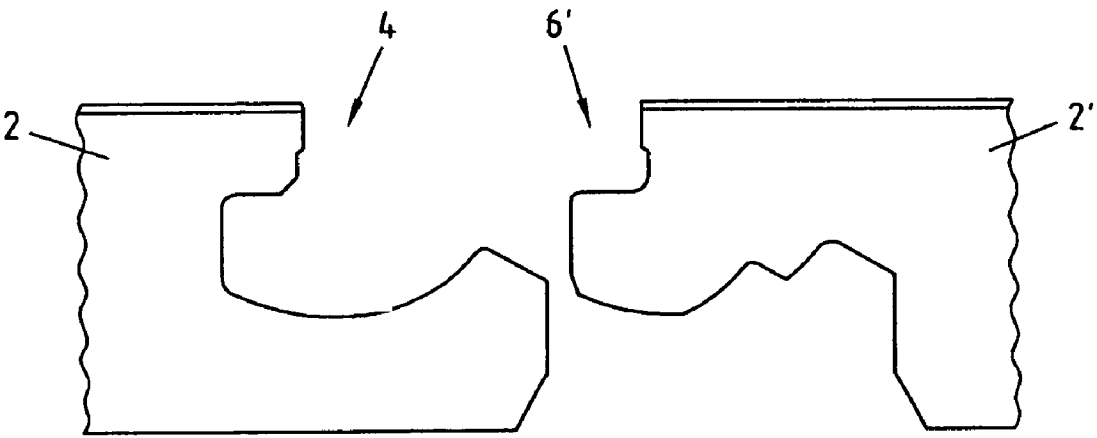
Fig. 5a2

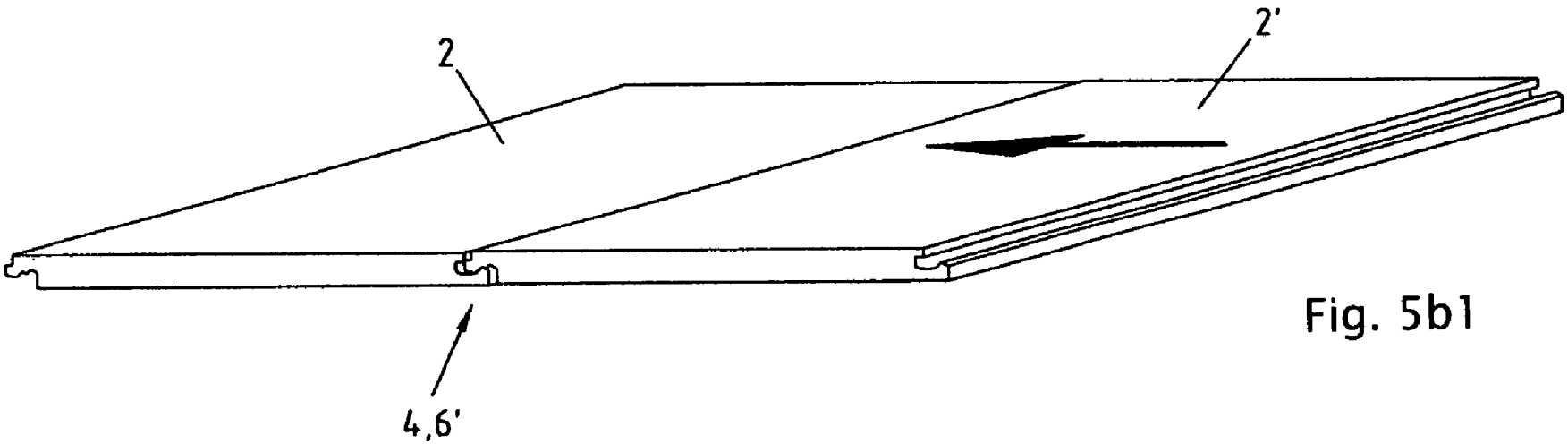
Fig. 5b1
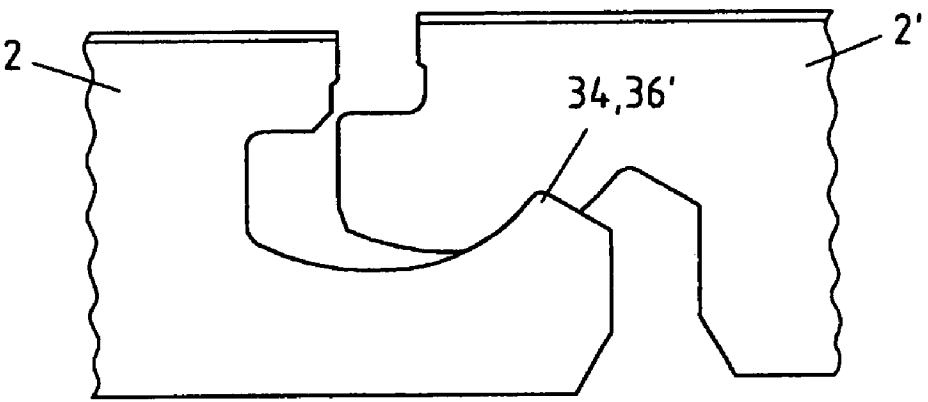
Fig. 5b2

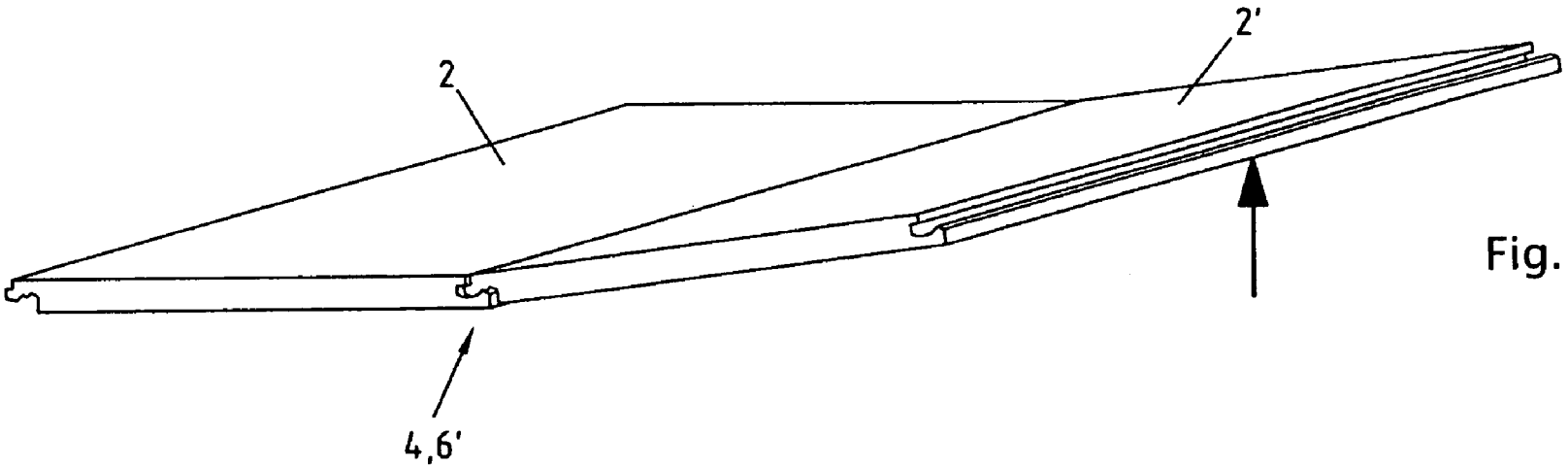
Fig. 5c1
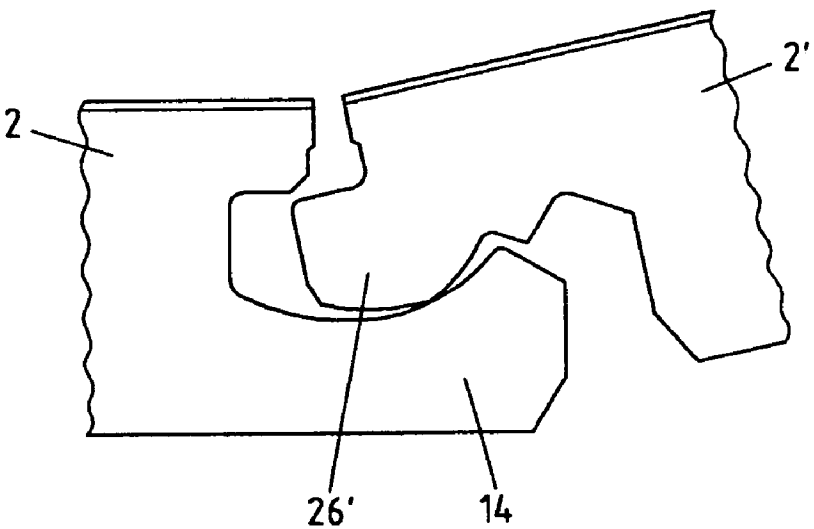
Fig. 5c2

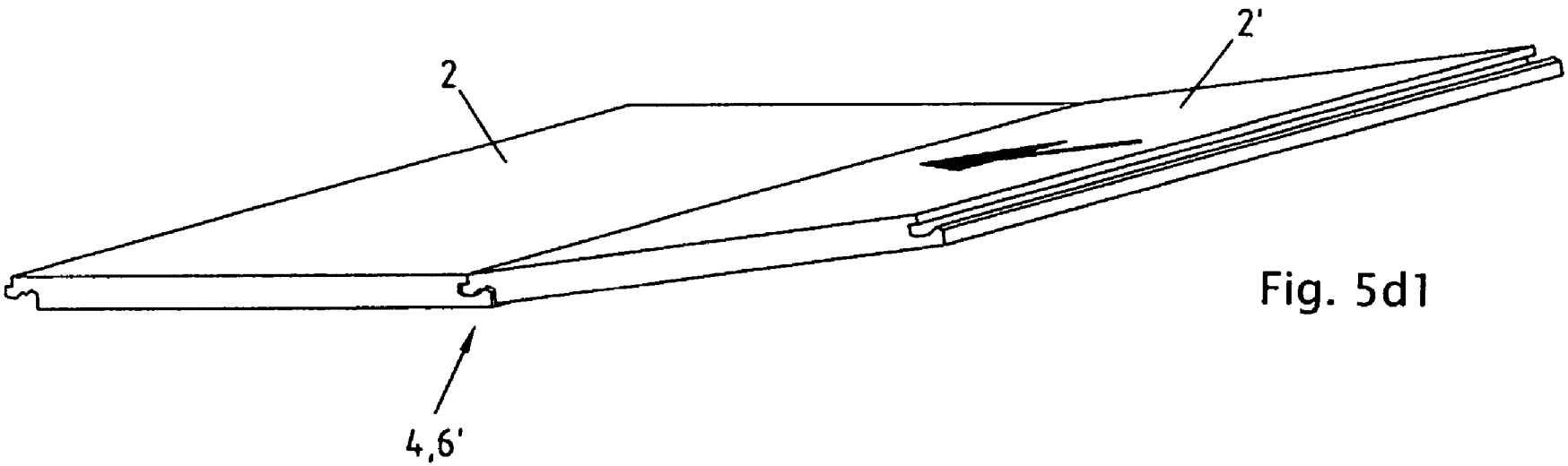
Fig. 5d1
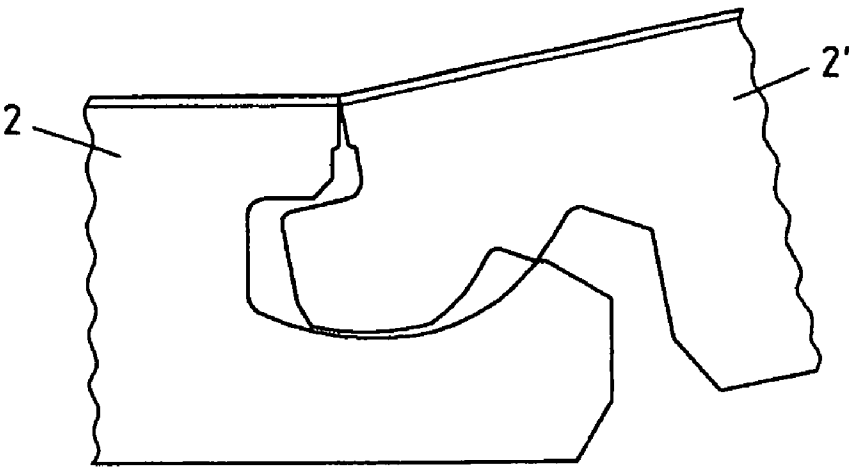
Fig. 5d2

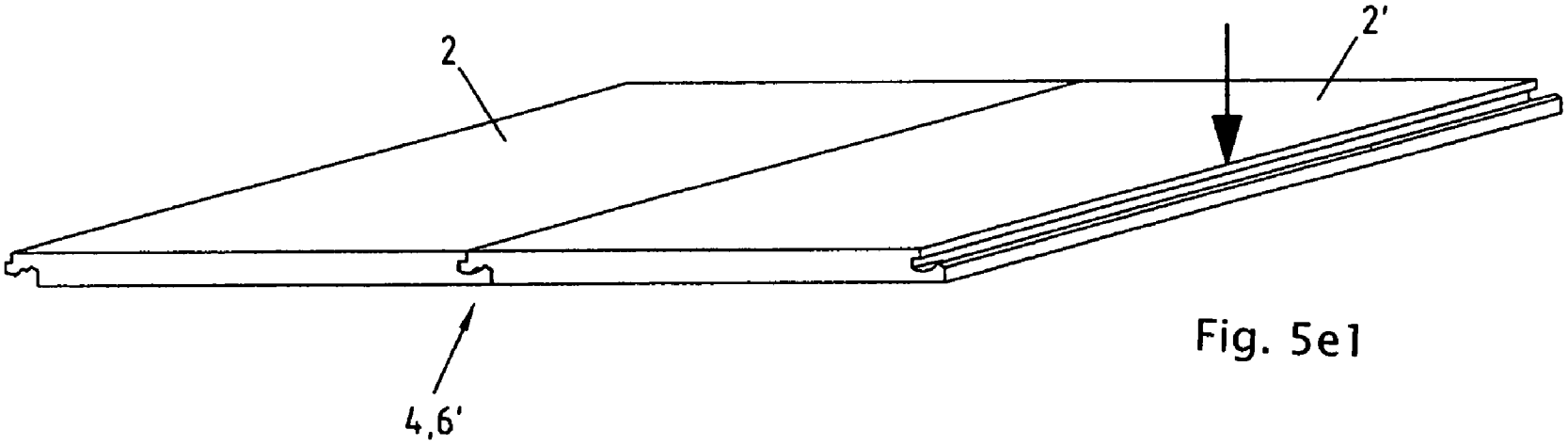
Fig. 5e1
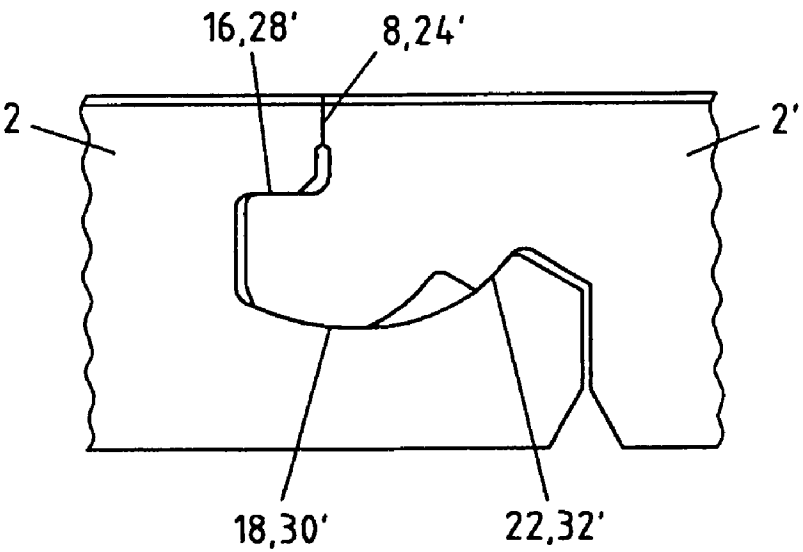
Fig. 5e2

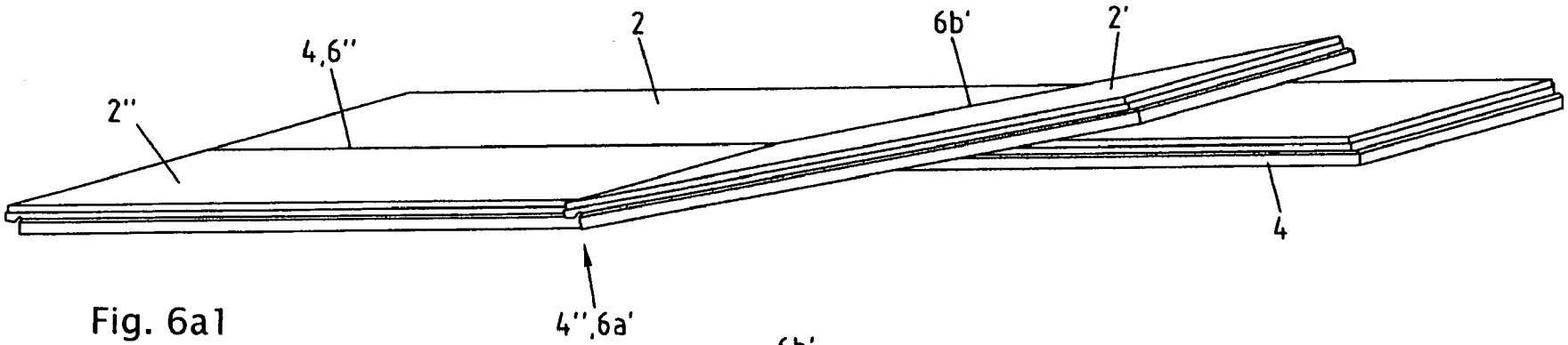
Fig. 6a1
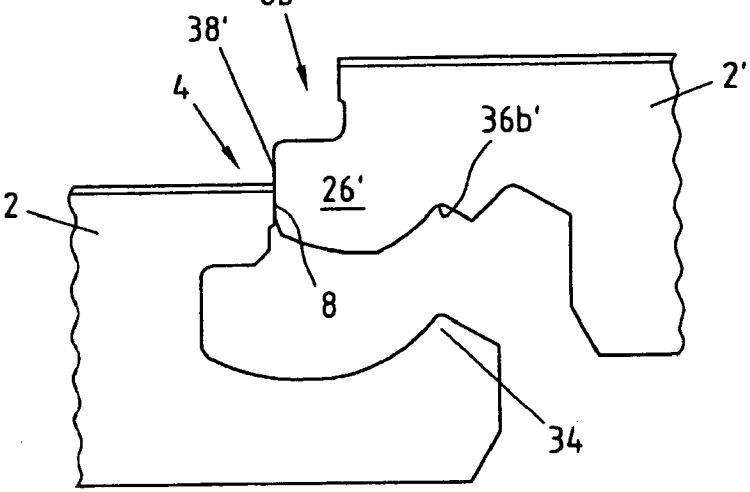
Fig. 6a2

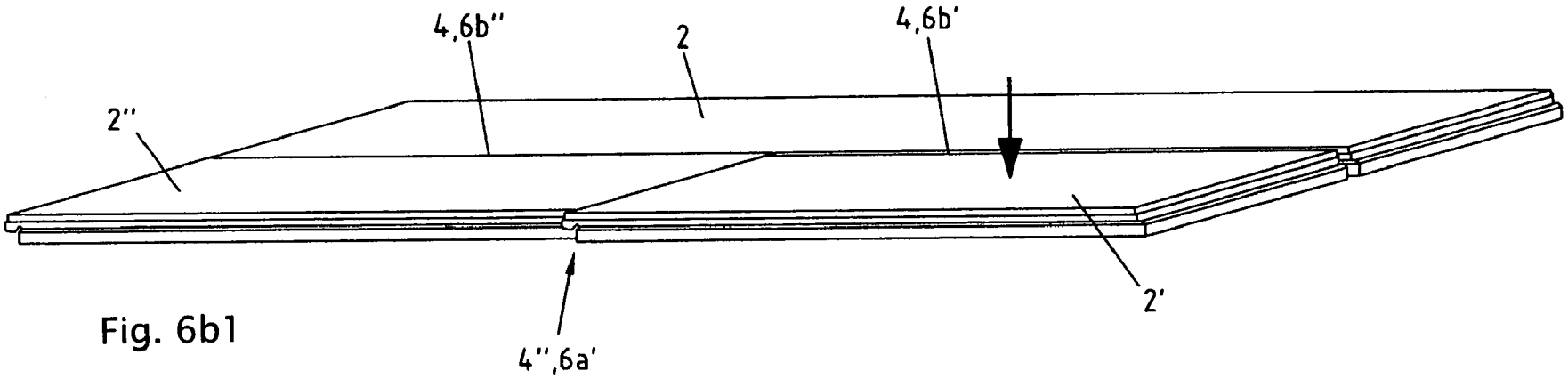
Fig. 6b1
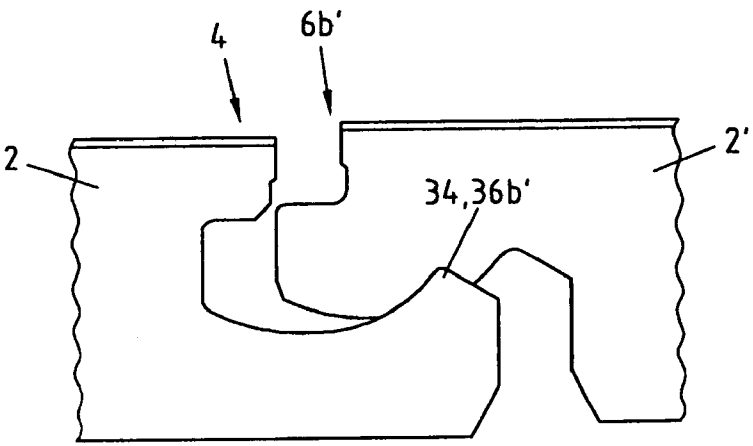
Fig. 6b2

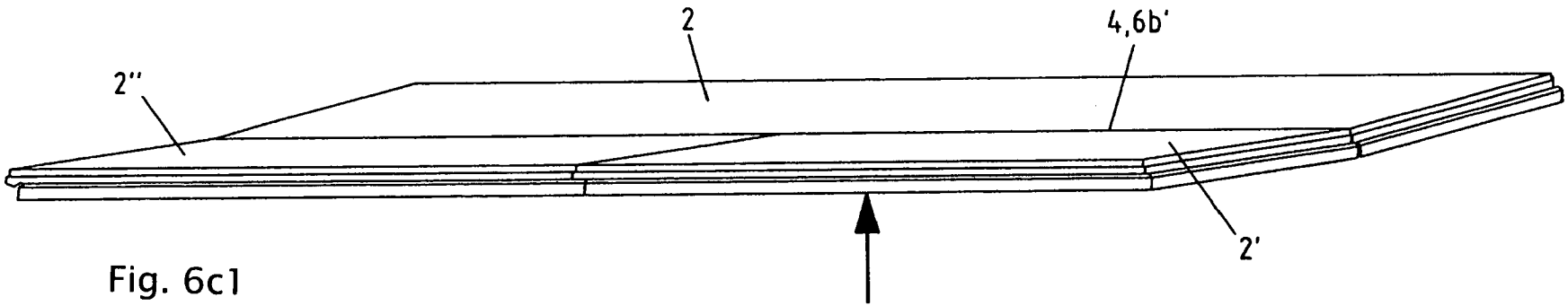
Fig. 6c1
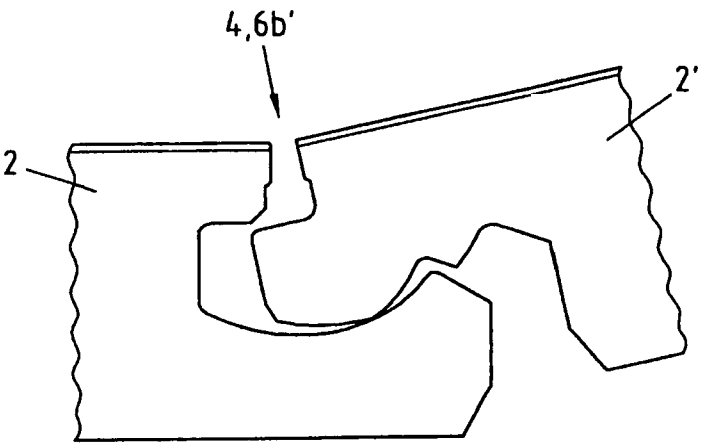
Fig. 6c2

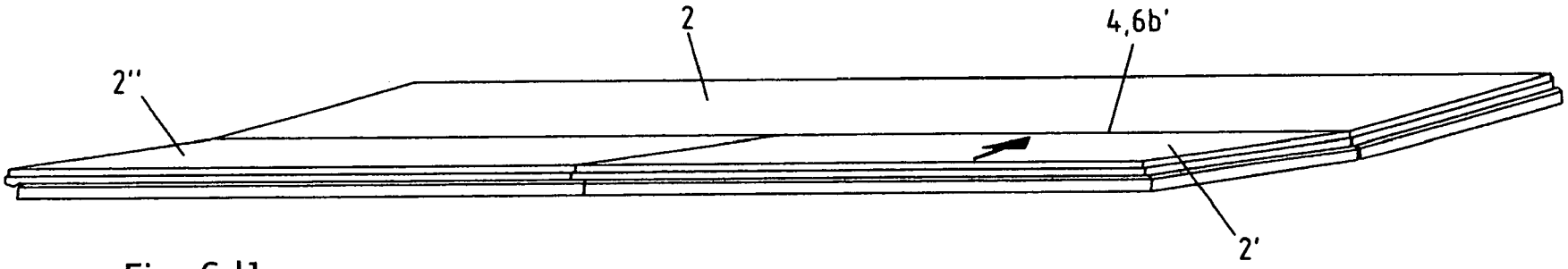
Fig. 6d1
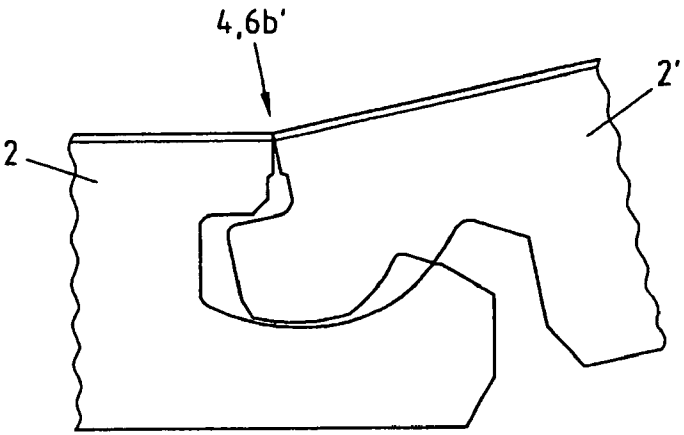
Fig. 6d2

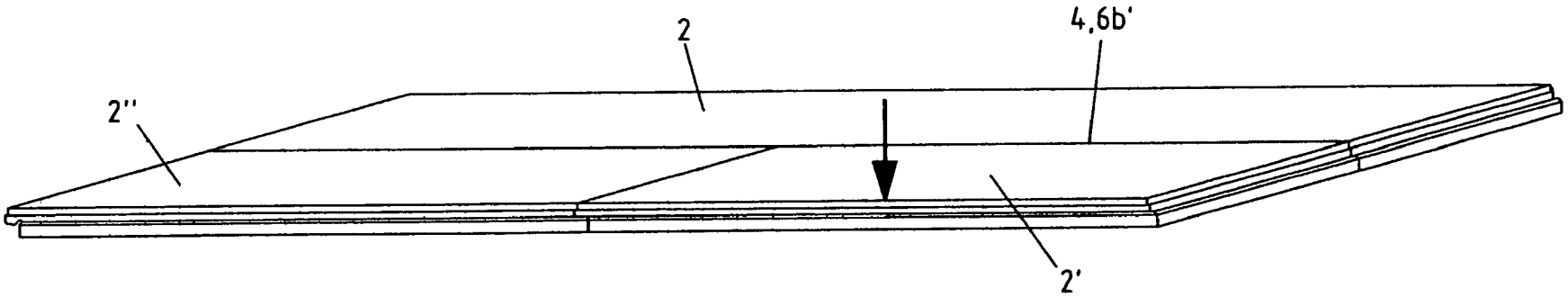
Fig. 6e1
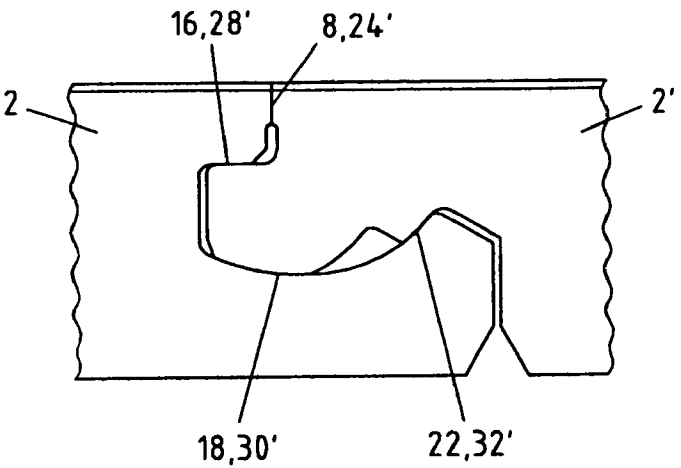
Fig. 6e2

INTERCONNECTABLE PANEL SYSTEM AND METHOD OF PANEL INTERCONNECTION

BACKGROUND OF THE INVENTION

This invention relates to an interconnectable panel and method of mechanically connecting that panel to other interconnectable panels. Such panels are used primarily as a floor covering (e.g., parquet or laminate flooring), but can alternatively be used as wall and ceiling coverings.

Individual panels that can be connected together to form a large, flat surface are known. Many such panels connect together mechanically without adhesives or separate mounting fasteners (e.g., screws or nails). This is advantageous because such panels can be installed quickly and removed easily.

These panels may be manufactured from laminate flooring panels made of a wood material. These panels may also be made of wood products in the form of parquet strips or panels or may alternatively be made of a plastic material.

Lateral (i.e., side edge) profile geometries of interconnectable panels having a tongue-and-groove connection for vertically interlocking panels are known. Lateral profile geometries of interconnectable panels having a pair of interlocking surfaces for horizontally interlocking panels are also known. These horizontal interlocking surfaces are usually obliquely aligned with respect to the top and side of the panels and usually engage one another via a "snap-action" or "snap-in" connection as the panels are interconnected.

The terms "snap-action" and "snap-in" connection refer to the manner in which the horizontal interlocking elements of a first panel lateral edge engage the complementary horizontal interlocking surfaces of a second panel lateral edge. Typically, this contact causes at least one element of the connection to bend or deflect during the interlocking process. Such connections, therefore, can only be made by overcoming a mechanical resistance, regardless of whether the panels are pushed toward one another horizontally or connected via a pivoting motion.

Moreover, if the bent or deflected element remains bent or deflected after the interconnection is complete, that connection is referred to as "non-positive." This means that the interlocking elements are at least partially bent or deflected in the connected state and consequently exert a reactive/contracting force.

Other panel connections are known to exhibit a "positive" connection. This means that the connecting elements are not bent or deflected after the panels are connected together. However, such connections typically still result in the horizontal connection elements/surfaces contacting each other and possibly bending or deflecting during the interconnection process.

A very precise fit between interconnection elements is very important, particularly with respect to the tongue and groove vertical interlock as well as the horizontal connection. However, this fit is typically impaired by forces resulting from the joining of known panels. These forces may, in particular, cause the connecting elements of the horizontal connection to deform, which can result in an inferior fit.

Furthermore, many known panels interconnect via a pivoting movement. Typically, a new panel is positioned at an angle along an already installed panel and then pivoted downward. Problems often arise, however, when interconnecting long panels along lateral edges (e.g., panel edges longer than about 3 feet (1 meter)). In particular, initially positioning panels at the correct angle over a long distance can be difficult, tedious, and time consuming. Moreover, a panel positioned at an incorrect angle will not connect properly during the pivoting movement and may even result in damage to the panel edge. Accordingly, known panel installation should be performed in a highly precise manner.

Other installation problems can occur in known interconnectable panel systems when connecting a new panel to two already installed panels. The two connected panels are connected along their long lateral edges (the panels are typically rectangular and connected along the long edge in a staggered manner). The new panel then needs to be connected to the first panel along the long lateral edge and to the second panel along the short lateral edge. This is typically done as follows: a short lateral edge of the new panel is first connected to the already installed second panel. Next, the new panel and the second panel are simultaneously raised and angled in order to slide the new panel toward the already installed first panel along the short lateral edge just connected to the second panel. This, however, causes the interconnection of the first and second panels to become unstable, and the second panel often disengages from the first panel along the long lateral edge. Thus, the attempt to install the new panel fails, and the second panel then needs to be reconnected to the first panel before the attempt to connect the new panel can be repeated.

In view of the foregoing, it would be desirable to be able to provide an interconnectable panel with an improved pivoting connection.

It would also be desirable to be able to provide a method of interconnecting panels via the improved pivoting connection.

SUMMARY OF THE INVENTION

It is an object of this invention to be able to provide an interconnectable panel with an improved pivoting connection.

It is also an object of this invention to be able to provide a method of interconnecting panels via the improved pivoting connection.

In accordance with the invention, an interconnectable panel that can be mechanically connected to another panel without adhesives or separate mounting fasteners (e.g., screws or nails) is provided with an improved pivot connection. Each panel (which may be, for example, square or rectangular) has a first lateral edge profile and preferably a complementary second lateral edge profile. The two profiles are complementary in that they can engage each other (when on respective panels) via a pivoting movement to produce a vertical interlock and a horizontal connection. The complementary profile geometries are preferably arranged on opposite lateral edges of the panel and may also be arranged on each pair of opposite lateral edges. They may alternatively be arranged in other ways (e.g., complementary profiles may be arranged on adjacent, rather than opposite, lateral edges, or one profile may be arranged on all sides of one panel while the other profile may be arranged on all sides of another panel).

The first lateral edge profile has the following features in accordance with the invention:

- a first contact surface located on the upper end of the first lateral edge,
- a groove,
- an upper lip that upwardly bounds the groove, a lower lip that downwardly bounds the groove, the lower lip having a distal end that protrudes beyond the distal end of the upper lip, a first fitting surface located on the upper lip, a second fitting surface located on the lower lip, and a second contact surface located on the lower lip at the distal end.

The first fitting surface and the second fitting surface form the vertical interlock on the first lateral edge, while the first contact surface and the second contact surface form the horizontal connection on the first lateral edge.

The second lateral edge profile has the following features in accordance with the invention:

a third contact surface located on the upper end of the second lateral edge, a tongue, a third fitting surface located on the upper side of the tongue, a fourth fitting surface located on the underside of the tongue at the distal end of the tongue, and a fourth contact surface located on the underside of the tongue spaced away from the distal end.

The third fitting surface and the fourth fitting surface form the vertical interlock on the second lateral edge, while the third contact surface and the fourth contact surface form the horizontal connection on the second lateral edge.

When two panels are connected to one another along respective complementary lateral edges, the first and third contact surfaces, the second and fourth contact surfaces, the first and third fitting surfaces, and the second and fourth fitting surfaces adjoin one another.

The first and second lateral edge profiles have the following additional features in accordance with the invention:

the distal end of the lower lip has a projection that protrudes upward;

the tongue has a depression on its underside between the fourth fitting surface and the fourth contact surface; and the projection and the tongue are shaped such that at least the upper end of the projection fits in the depression.

Methods of interconnecting panels via a pivoting movement are also provided in accordance with the invention. In particular, the first and second lateral edge profiles advantageously allow the joining of two panels in preferably only two steps/sequences of movements. Moreover, two panels can be fabricated in accordance with the invention such that they may either be joined in the form of a positive fit (i.e., without bent or deformed interlocking elements) or in the form of a non-positive connection.

In one embodiment of the invention, the method includes positioning a second panel on a surface (e.g., a floor) a distance away from a first panel such that a first lateral edge of the first panel is opposite a second lateral edge of the second panel. The second panel is then moved into a position in which the depression of the second panel engages the projection of the first panel. This can be considered an intermediate position in which both panels assume a defined position relative to one another and are also partially engaged. This position may also be referred to as a levering position, because the final position is subsequently reached by a mutual lever action and shifting of the angularly positioned panels.

To complete the interconnection, the second panel is positioned at an angle (wherein the second lateral edge of the second panel remains in contact with the first lateral edge of the first panel) and moved (while in the angled position) in the direction of the first lateral edge of the first panel until the upper corners of the lateral edges contact one another. The second panel is then pivoted downward. This causes the fitting and contact surfaces of both lateral edges to come in contact with one another.

Because the two lateral edges already are partially engaged in the intermediate/levering position, both panels can be subsequently held at an angle relative to one another without easily becoming disengaged. This simplifies the handling of the panels during the second step of the method, resulting in a simple and fast installation.

Advantageously, the second panel preferably is moved toward the first panel essentially parallel to the surface (e.g., floor). The second panel is only raised at the end of this movement in order to engage the projection with the depression. Thus, it is no longer necessary to laboriously hold at an angle and correspondingly position the new panel relative to the already installed panel, and that simplifies the handling.

Another embodiment of the invention includes a method for installing several panels such that they form a flat large-surface unit. These panels mechanically engage each other along adjoining lateral edges and respectively comprise two pairs of oppositely arranged first lateral edges and second lateral edges.

This method begins after a first row of panels has been installed and a second row has been started. In other words, a first lateral edge of a first panel has already been connected to a second lateral edge of a second panel. The first panel is arranged in a row of panels, which already may be completely installed, while the second panel is arranged in a new row and already may have been connected to additional panels in that new row with its opposite (second) lateral edge.

The second lateral edge of a new panel to be installed in the new row is angularly placed against a first lateral edge of the second panel, wherein the depression of another second lateral edge of the new panel is positioned above the projection of the first lateral edge of the first panel. The new panel is connected to a first lateral edge of the second panel by pivoting the new panel downward such that the depression of the new panel is engaged with the projection of the first panel.

This completes the first step of this method. At this point, the new panel is completely connected to the second panel along the corresponding lateral edges while the lateral edges of the new panel and the first panel are partially engaged (corresponding to the levering position).

At the beginning of the second step, the new panel is held at an angle together with the second panel, wherein the second lateral edge of the new panel remains in contact with the first lateral edge of the first panel. In particular, the underside of the tongue and the upper side of the lower lip are in contact along a contact line that is shifted during the second step movement. While in the angled position, the new panel is moved in the direction of the first lateral edge of the first panel until the upper corners of the lateral edges contact one another, wherein the lateral edges of the second panel and the second lateral edge of the new panel remain connected to one another. The new panel is then pivoted downward together with the second panel until the fitting and contact surfaces of the first lateral edge of the first panel and the second lateral edge of the new panel contact one another.

The second panel is angled relative to the first panel by preferably less than 15°, more preferably by less than 12°, and most preferably by less than 10°. These angles are sufficiently small to ensure that the partially engaged lateral edges cannot be disengaged during the subsequent sliding movement unless they are subjected to an additional movement or force.

In another method embodiment of the invention, a new panel is angularly positioned on the first lateral edge of the second panel, wherein a section of the distal end of the tongue of the new panel adjoins a section of the first contact surface of the first panel. The contact between the tongue of the new panel and the first lateral edge of the first panel further simplifies this interconnection method because it is easier to adjust the position in which the projection is positioned underneath the depression and automatically engages the depression when the new panel is subsequently pivoted downward.

BRIEF DESCRIPTION OF THE DRAWINGS

The above and other advantages of the invention will be apparent upon consideration of the following detailed description, taken in conjunction with the accompanying drawings, in which like reference characters refer to like parts throughout, and in which:

FIGS. 5*a*1,*a*2–5*e*1,5*e*2 are alternating perspective and side elevational views of two panels being interconnected according to the invention; and FIGS. 6*a*1,*a*2–6*e*1,6*e*2 are alternating perspective and cross-sectional views of panels being interconnected according to the invention.

DETAILED DESCRIPTION OF THE INVENTION

Figure 1:
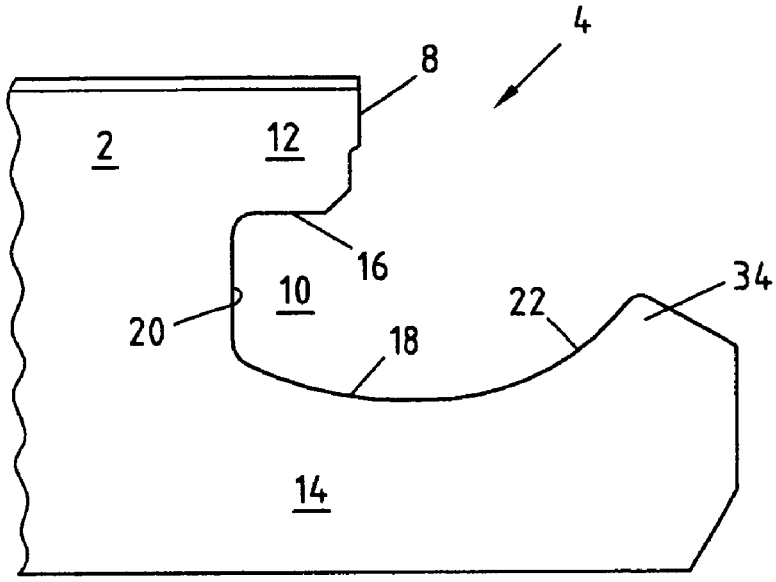
FIG. 1 is a side elevational view of a first lateral edge of a panel according to the invention.

FIG. 1 shows a first lateral edge of a panel 2 in accordance with the invention. First lateral edge 4 has a first contact surface 8 located on the upper end of first lateral edge 4. A groove 10 has a back-surface 20 and is formed by an upper lip 12 that upwardly bounds groove 10 and by a lower lip 14 that downwardly bounds groove 10. The distal end of lower lip 14 protrudes beyond the distal end of upper lip 12. A first fitting surface 16 is located on upper lip 12 and a second fitting surface 18 is located on lower lip 14 away from the distal end of lower lip 14 and preferably in the groove bottom region. A second contact surface 22 is also located on lower lip 14 in the region of the distal end of lower lip 14.

Figure 2:
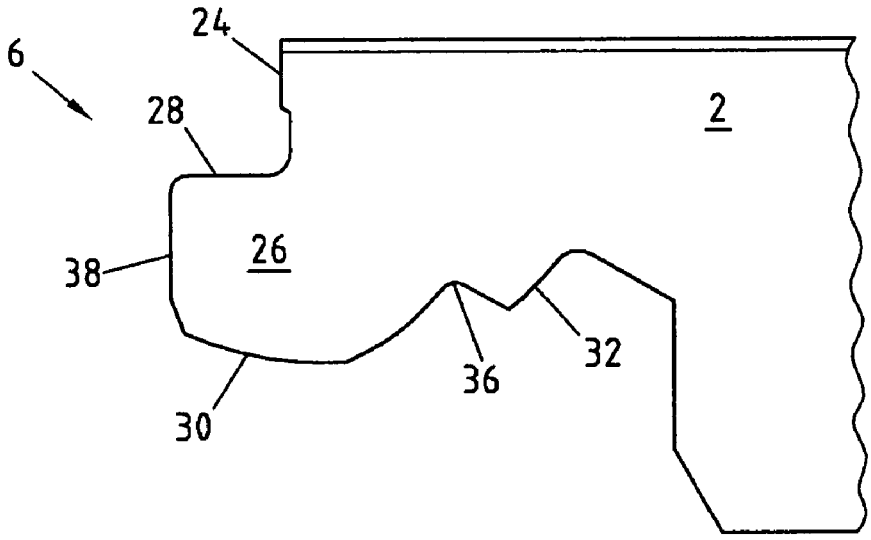
FIG. 2 is a side elevational view of a second lateral edge of a panel according to the invention.

FIG. 2 shows a second lateral edge of panel 2 in accordance with the invention. Second lateral edge 6 is complementary to lateral edge 4 (i.e., they can interconnect with each other when on separate panels). A third contact surface 24 is located on the upper end of second lateral edge 6. Second lateral edge 6 also has a tongue 26 extending from it. Tongue 26 has a third fitting surface 28 located on top of the tongue and a fourth fitting surface 30 located on the underside of the tongue at the tongue's distal end. A fourth contact surface 32 is also located on the underside of the tongue 26, but spaced away from the distal end.

Note that lateral edge 6 alternatively need not be on panel 2, but can instead be on another panel which may or may not have a lateral edge 4 in accordance with the invention.

Figure 3:
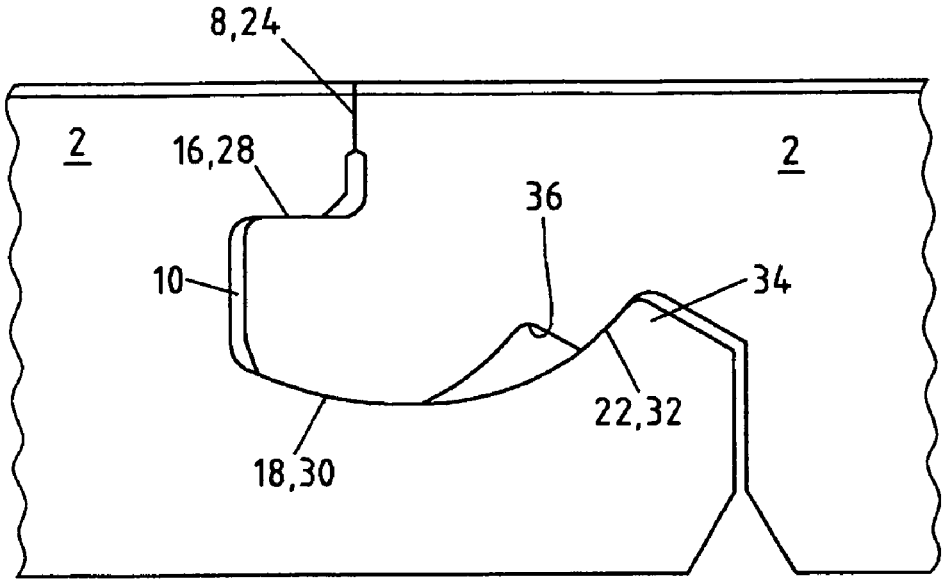
FIG. 3 is a side elevational view of a first lateral edge of one panel completely engaged with a second lateral edge of another panel according to the invention.

FIG. 3 shows an interconnection of lateral edges 4 and 6 of respective panels in accordance with the invention. This interconnection results in the following pairs of adjoined surfaces: first contact surface 8 and third contact surface 24, second contact surface 22 and fourth contact surface 32, first fitting surface 16 and third fitting surface 28, and second fitting surface 18 and fourth fitting surface 30.

The distal end of the lower lip 14 has a projection 34 that protrudes upward and is bounded by second contact surface 22 on a side of the projection that roughly faces groove back-surface 20. In addition, tongue 26 has a depression 36 on its underside between fourth fitting surface 30 and fourth contact surface 32. Depression 36 is shaped to receive at least the upper end of projection 34.

Figure 4:
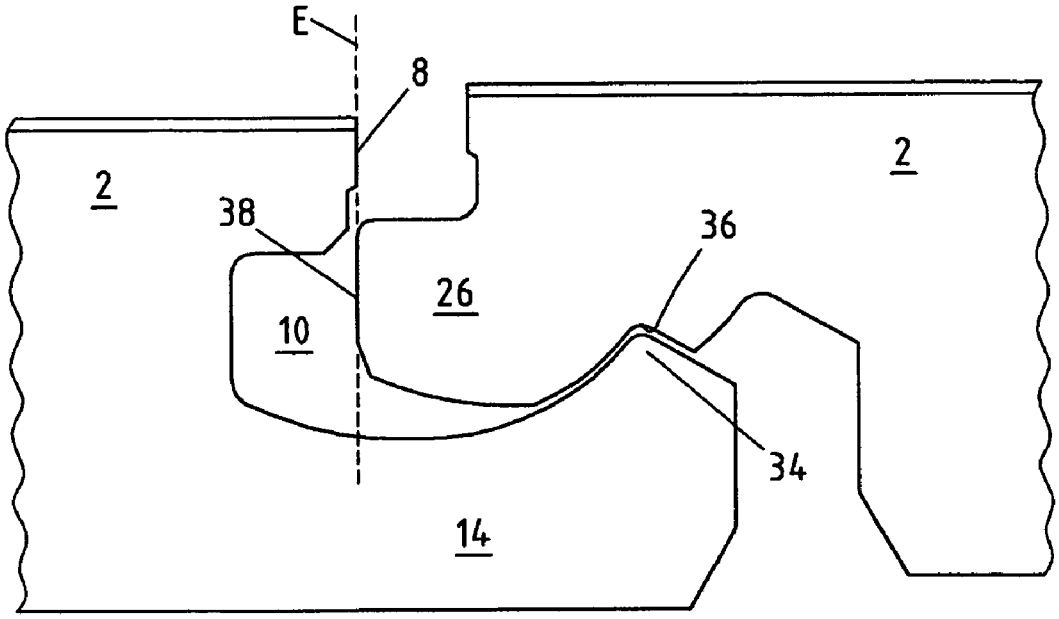
FIG. 4 is a side elevational view of the two panels of FIG. 3 in an intermediate position according to the invention.

Projection 34 and depression 36 make possible the levering position of two panels, as shown in FIG. 4, in which projection 34 fits in depression 36 (note that for clarity, projection 34 and depression 36 are illustrated with a space between them—naturally, the surfaces of both elements adjoin one another when they are in the levering position). In this embodiment, depression 36 and the upper end of projection 34 are each V-shaped (the point of the V is directed upward as shown). This simple shape ensures that two panels in the levering position can only be displaced relative to one another if they are subjected to a force. In other words, the levering position is a stable position that, however, can be easily changed. Note that the shape of the depression and projection is not limited to that of a "V" (other shapes may be used).

The lateral edge embodiments shown in FIGS. 1–4 result in a positive fit, which is a preferred design. That is, none of the elements of lateral edges 4 and 6 are deflected or bent in the interconnected state. Note that contact surfaces 22 and 32 do not engage one another until the pivoting movement carried out during the joining of the two lateral edges 4 and 6 is completed.

The invention is not limited to lateral edge profiles with a positive fit. Contact surfaces 22 and 32 may be prestressed relative to one another due to an elastic material deformation of lower lip 14 or tongue 26 (i.e., lower lip 14 and/or tongue 26 deflects or bends and remains so after interconnection). This results in a non-positive connection between two panels.

FIG. 4 shows another preferred feature of the profile geometry. When projection 34 of a first panel 2 is engaged with depression 36 of a second panel 2, distal end 38 of tongue 26 is located outside a plane E that extends perpendicular to the upper side of panel 2 along first contact surface 8 ("outside" being defined as to the right of plane E as shown in FIG. 4 (i.e., in the direction of the distal end of lower lip 14), plane E shown as a dashed line). The particular advantage of this design is described in more detail below with respect to FIGS. 6*a*–*e*.

FIGS. 5*a*1,5*a*2–5*e*1,5*e*2 (each pair collectively referred to as FIG. 5*x*, where x is *a,b,c,d,e*) illustrate a first method of installing panels via a mechanical connection along complementary lateral edges in accordance with the invention. FIGS. 5*x*1 show perspective representations of the relative positions of two panels 2 and 2', and FIGS. 5*x*2 show side elevational representations of the positions of the first and second lateral edges 4 and 6'.

FIG. 5*a* shows a first panel 2 arranged on a surface (e.g., floor). A second panel 2' is arranged on the surface such that it is spaced apart from first panel 2 and that a first lateral edge 4 of first panel 2 is situated opposite a second lateral edge 6' of second panel 2'.

FIG. 5*b* shows second panel 2' moved into a position in which depression 36' of second panel 2' is engaged with projection 34 of first panel 2. This position is the levering position and is reached by initially displacing second panel 2' horizontally (in the direction of the arrow shown on panel 2') until both lateral edges 4 and 6' lie near one another. Subsequently, second panel 2' is raised and additionally displaced until depression 36' is positioned above projection 34. Second panel 2' is then lowered into the levering position shown in FIG. 5*b*.

Alternatively, the levering position can be reached by placing second lateral edge 6' of second panel 2' against first lateral edge 4 of first panel 2 in an angled fashion, for example, such that tongue 26' and lower lip 14 contact one another. The levering position is reached by then lowering second panel 2'.

FIG. 5*c* shows second panel 2' angled (i.e., raised in the direction of the arrow shown). During this process, second lateral edge 6' of second panel 2' remains in contact with first lateral edge 4 of first panel 2. This contact takes place along the lower surface of tongue 26' and the upper surface of lower lip 14.

FIG. 5*d* shows second panel 2' moved in the direction of first lateral edge 4 of first panel 2 while in the angled position until the upper corners of lateral edges 4 and 6' contact one another. (This movement is also indicated by the arrow shown on panel 2'.)

FIG. 5*e* shows second panel 2' subsequently pivoted downward until fitting surfaces 16,28' and 18,30' and contact surfaces 8,24' and 22,32' are in contact with one another. (This downward pivot movement is indicated by the arrow shown in FIG. 5*e*1.)

The joining of panels 2 and 2' consequently occurs in two steps. In the first step, the sequence of movements illustrated in FIGS. 5*a* and 5*b* is carried out until the levering position is reached. In the second step, the sequence of movements shown in FIGS. 5*c*–*e* is carried out. Again, the term "levering position" refers to the lever-type engagement between lateral edges 4 and 6', which involves a lifting movement and a displacement to the levering position, and a lowering movement after the levering position.

A second embodiment of the method in accordance with the invention is illustrated in FIGS. 6*a*1,6*a*2–6*e*1,6*e*2 (each pair collectively referred to as FIG. 6*x*, where x is *a,b,c,d,e*). FIGS. 6*x*1 show perspective representations of the relative positions of three panels 2, 2', and 2", and FIGS. 6*x*2 show cross-sectional representations of the positions of the first and second lateral edges 4 and 6*b*' of panels 2 and 2', respectively (as viewed from the left side of the drawing looking toward the right side).

FIG. 6*a* shows a first panel 2 positioned on a surface (e.g., a floor) together with a second panel 2". The first lateral edge 4 of first panel 2 has already been connected to a second lateral edge 6" of a second panel 2". The second lateral edge 6*a*' of a new panel 2' is angularly placed against a first lateral edge 4" of second panel 2", wherein a depression 36*b*' of second lateral edge 6*b*' of new panel 2' is positioned above projection 34 of first lateral edge 4 of first panel 2.

In this first step, new panel 2' preferably is angularly placed against first lateral edge 4" of second panel 2" in such a way that a section of distal end 38' of tongue 26' adjoins a section of first contact surface 8 of first panel 2. This significantly simplifies the positioning of new panel 2' relative to first panel 2, because the subsequent lowering movement automatically causes projection 34 to be inserted or fitted into depression 36*b*'. This is why distal end 38' of tongue 26' lies outside plane E in the levering position as shown in FIG. 4.

In FIG. 6*b*, new panel 2' has been pivoted downward (as indicated by the arrow in FIG. 6*b*1) and is connected to first lateral edge 4" of second panel 2". Also, depression 36*b*' of new panel 2' is engaged with projection 34 of first panel 2.

FIG. 6*c* shows new panel 2' positioned at an angle together with second panel 2". In this position, second lateral edge 6*b*' of new panel 2' remains in contact with first lateral edge 4 of first panel 2. This positioning is indicated with an arrow shown in FIG. 6*c*1.

In FIG. 6*d*, new panel 2' is moved in the direction of first lateral edge 4 of first panel 2 while in the angled position (see arrow) until the upper corners of lateral edges 4 and 6*b*' contact one another. During this movement, lateral edges 4" of second panel 2" and second lateral edge 6*a*' of new panel 2' remain connected to one another.

When angling new panel 2' relative to first panel 2, new panel 2' and second panel 2" preferably are essentially aligned relative to one another in one plane. Because of this, panels 2' and 2" are prevented from separating (i.e., lateral edges 4" and 6*a*' are prevented from disengaging each other).

FIG. 6*e* shows the result of the last step in which new panel 2' is pivoted downward (see arrow) together with second panel 2" until fitting surfaces 16,28' and 18,30 and contact surfaces 8,24 and 22,32' come in contact with one another.

Advantageously, moving new panel 2' along with first panel 2 into the levering position is relatively simple, because new panel 2' is connected to short lateral edge 4" along short lateral edge 6*a*'. This connection can be easily made because the lateral edges to be connected are not very long.

The situation is different along the long lateral edges 4 and 6*b*' and 4 and 6". In this case, the alignment of panels 2' and 2" relative to first panel 2 should be observed in order to prevent lateral edges 6*b*' and 6" from sliding out of lateral edge 4. In the levering position, the lateral edges already are partially engaged with one another and are consequently aligned very well at the beginning of the second step of the method. In addition, part of the tongue already is advantageously situated beyond the projection of the lower lip, so in order to completely disengage the connection, a movement in the direction opposite to the levering movement is required.

Note that first panel 2 may be alternatively composed of several individual panels in order to form the long lateral edge 4 that connects panels 2' and 2".

In both previously described methods, the new panel only needs to be slightly angled in order to connect the new panel to the already installed first panel. Second panel 2' is angled relative to first panel 2 by preferably less than 15°, more preferably by less than 12°, and most preferably by less than 10°. These angles ensure, in particular, that the partially produced connection is preserved in the levering position, because a larger angle is usually required to disengage a tongue that is already partially inserted at this point.

Thus it is seen that an interconnectable panel with an improved pivot connection and corresponding interconnection method are provided. One skilled in the art will appreciate that the invention can be practiced by other than the described embodiments, which are presented for purposes of illustration and not of limitation, and the invention is limited only by the claims which follow.

I claim:

1. A panel mechanically connectable to another panel, the panel comprising:

a first lateral edge having:

a first contact surface located on an upper end of the first lateral edge and defining a first plane, a groove, an upper lip that upwardly bounds the groove, a lower lip that downwardly bounds the groove, the distal end of the lower lip protruding beyond the distal end of the upper lip, the distal end of the lower lip having a projection that protrudes upward to a point of greatest projection defining a first distance from said first plane, a first fitting surface located on the upper lip, a second fitting surface located on the lower lip away from the distal end of the lower lip, and a second contact surface located on the lower lip at the distal end of the lower lip, the second contact surface bounding a side of the projection; and a second lateral edge having:

a third contact surface located on an upper end of the second lateral edge, a tongue extending from the second lateral edge, a third fitting surface located on the top of the tongue, a fourth fitting surface located on the underside of the tongue at the distal end of the tongue, said distal end of the tongue defining a second plane, and a fourth contact surface located on the underside of the tongue away from the distal end of the tongue; wherein:

the tongue has a depression on its underside between the fourth fitting surface and the fourth contact surface, said depression having a point of greatest depression defining a second distance from said second plane;

the depression and the projection are shaped such that at least the upper end of the projection fits in the depression, and said second distance is at most equal to said first distance; and the first and second lateral edges are connectable to each other when on respective panels such that when the respective panels are connected to each other the first contact surface and the third contact surface, the second contact surface and the fourth contact surface, the first fitting surface and the third fitting surface, and the second fitting surface and the fourth fitting surface respectively adjoin one another.

2. The panel of claim 1 wherein the second contact surface and the fourth contact surface engage each other in the form of a positive fit when either surface is also on a lateral edge of another panel connected to the panel.

3. The panel of claim 1 wherein the second contact surface and the fourth contact surface engage each other in the form of a non-positive connection when either surface is also on a lateral edge of another panel connected to the panel.

4. The panel of claim 1 wherein the depression and the upper end of the projection are V-shaped.

5. The panel of claim 4 wherein the second contact surface and the fourth contact surface engage each other in the form of a positive fit when either surface is also on a lateral edge of another panel connected to the panel.

6. The panel of claim 4 wherein the second contact surface and the fourth contact surface engage each other in the form of a non-positive connection when either surface is also on a lateral edge of another panel connected to the panel.

7. An interconnectable panel system comprising:

a first panel having a lateral edge, the lateral edge having:

a first contact surface located on an upper end of the first lateral edge, a groove, an upper lip that upwardly bounds the groove, a lower lip that downwardly bounds the groove, the distal end of the lower lip protruding beyond the distal end of the upper lip, the distal end of the lower lip having a projection that protrudes upward, a first fitting surface located on the upper lip, a second fitting surface located on the lower lip away from the distal end of the lower lip, and a second contact surface located on the lower lip at the distal end of the lower lip, the second contact surface bounding a side of the projection; and a second panel having a lateral edge, the second panel lateral edge having:

a third contact surface located on an upper end of the second panel lateral edge, a tongue extending from the second panel lateral edge, a third fitting surface located on the top of the tongue, a fourth fitting surface located on the underside of the tongue at the distal end of the tongue, and a fourth contact surface located on the underside of the tongue away from the distal end of the tongue, the tongue having a depression on its underside between the fourth fitting surface and the fourth contact surface; wherein:

the first and second panels are interconnectable along their respective lateral edges such that when connected the first contact surface and the third contact surface, the second contact surface and the fourth contact surface, the first fitting surface and the third fitting surface, and the second fitting surface and the fourth fitting surface respectively adjoin each another;

the depression and the projection are shaped such that at least the upper end of the projection can fit in the depression; and when the projection is engaged with the depression, the distal end of the tongue is positioned on a the same side of a plane as the distal end of the lower lip, the plane being aligned with the first contact surface of the first panel.

8. The system of claim 7 wherein the depression and the upper end of the projection are V-shaped.

9. The system of claim 7 wherein the second contact surface and the fourth contact surface engage each other in the form of a positive fit when the first and second panels are interconnected to each other.

10. The system of claim 7 wherein the second contact surface and the fourth contact surface engage each other in the form of a non-positive connection when the first and second panels are interconnected to each other.

* * * * *